US005850060A

United States Patent [19]

Gerber et al.

[11] Patent Number: 5,850,060

[45] Date of Patent: Dec. 15, 1998

[54] ACOUSTIC LENS DEVICE

[76] Inventors: Allen Gerber; Laura Gerber, both of 42 Nutmeg Dr., High Falls, N.Y. 12440; Nicole Theobald, 635 N. McArthur, Apt. 3, Macomb, Ill. 61455

[21] Appl. No.: 835,016

[22] Filed: Apr. 8, 1997

[51] Int. Cl.[6] ..... G10K 11/00

[52] U.S. Cl. ..... 181/175; 181/141; 181/176

[58] Field of Search ..... 181/175, 176, 181/141, 150, 155, 18, 30; 381/86, 160

[56] References Cited

U.S. PATENT DOCUMENTS

| | | | |
|---|---|---|---|
| 2,643,727 | 6/1953 | Leon | 181/155 |
| 3,908,095 | 9/1975 | Jinsenji | 181/176 X |
| 5,031,220 | 7/1991 | Tagaki et al. | 381/86 |
| 5,268,539 | 12/1993 | Ono | 181/155 |

*Primary Examiner*—Khanh Dang

*Attorney, Agent, or Firm*—John F. Vodopia

[57] ABSTRACT

An acoustic lens device is provided for use in facilitating oral communication in a space which is acoustically challenged. The lens device includes at least one acoustic reflector for positioning proximate to a dashboard of a passenger portion of a transport vehicle. The reflector is formed by an upper portion with an ellipsoidal surface obtained when an ellipse having two foci on an axis extending in a substantially vertical direction is rotated about the axis. In consequence, the upper portion encloses at least one of the two foci such that each of the at least one reflectors is disposed at a predetermined distance from the other with parallel axes. The first loci is disposed such that voice signals emitted from the mouths of persons seated in the front passenger compartment are directed from the first foci to the device. Accordingly, a sound pressure of a voice signal reaches the axis of the at least one reflector and is focused by the device and directed to the second focus in the back passenger portion.

8 Claims, 1 Drawing Sheet

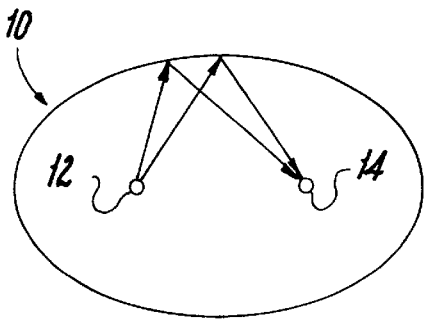
Fig. 1
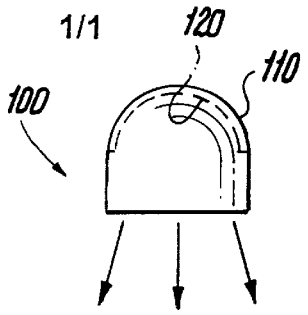
Fig. 2A
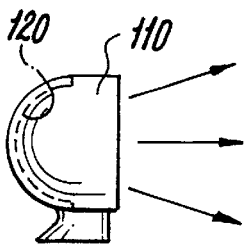
Fig. 2B
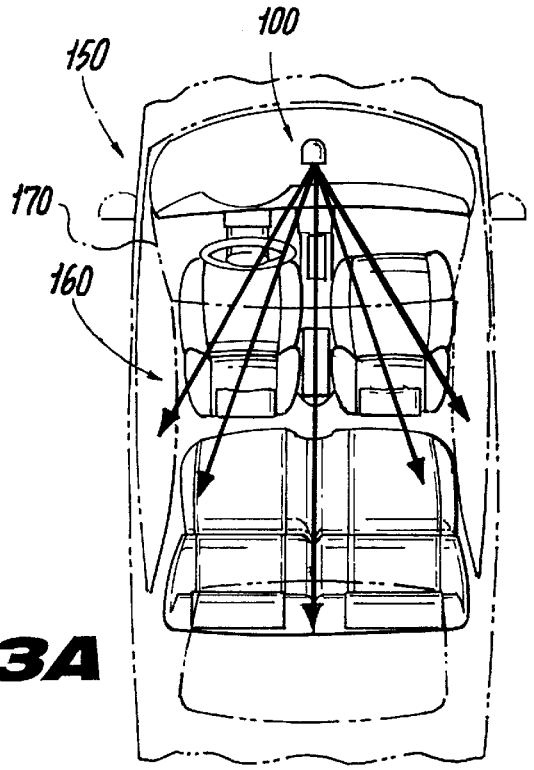
Fig. 3A
Fig. 3B
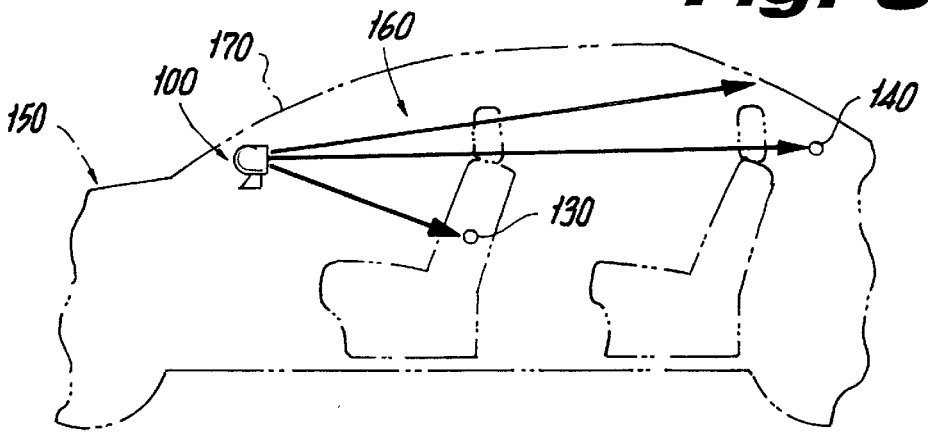

ACOUSTIC LENS DEVICE

BACKGROUND OF THE INVENTION

The present invention relates to focusing sound waves and, more particularly, relates to an acoustic lens device for motor vehicles which collects sound waves emanating from a speaker and directs the sound waves to an area defined by the foci of the lens device.

The principles upon which acoustic lens devices operate are known to those skilled in the art. That is, when sound waves emanating from a sound source are received at a variously curved reflector having a focus, the sound waves are caused to diverge or scatter. This principle is used in practice within the acoustic design of buildings, such as outdoor/indoor concert halls, and for directing sounds to be heard by only a specific person or at only a specific space or spaces. Acoustic lens devices are known to include reflectors which are capable of amplifying and focusing sounds so that they may be heard only within a specific area without the need for an earphone. For example, U.S. Pat. No. 5,268,539 discloses a reflector-based acoustic lens device which includes a reflector whose inner surface is provided with part of an ellipsoidal surface of revolution having two foci. A sound source disposed at one of the foci directs sound at the reflector which reflects and converges the sound at the second foci. The acoustic apparatus of the '539 patent amplifies and focuses sound to be heard in a specific area without need of an earphone to hear same.

SUMMARY OF THE INVENTION

Accordingly, a primary object of this invention is to provide an acoustic apparatus for mounting on or about a dashboard of a motor vehicle in order to project sound directed towards the device into the back passenger portion of the vehicle to facilitate verbal communication. The acoustic apparatus preferably has an ellipsoidal surface reflector for amplifying and focusing sound generated by persons in a front passenger portion of a motor vehicle or craft the back portion of the same vehicle or craft. The acoustic lens device for motor vehicles of the present invention is used to facilitate conversation within acoustically challenged spaces, such as the back passenger compartments of a motor vehicle, where the exact location of persons whose voices are to be focused is within an area of a first focus on an ellipsoidal reflector for efficacious focusing and transfer of the sound to a second focus of the same reflector. For that matter, the sound received from a locus of points in space at the first focus, in which one or more persons are located, is directed to a locus of points in space in another portion of the motor vehicle at or near the second focus of the ellipsoidal reflector.

An acoustic lens device is provided for use in facilitating oral communication in spaces within motor vehicles which are acoustically challenged. The acoustic lens device includes at least one ellipsoid shaped acoustic reflector for positioning on a dashboard or windshield within a passenger portion of a transport vehicle. The reflector is formed by an upper portion with an ellipsoidal surface having two foci on an axis extending in a substantially vertical direction which is rotated about the axis. Dimensions of the reflector are designed such that a first foci is defined by the lens device to be in an area where voice signals, emitted from the mouths of persons seated within an area of the first focus, i.e., the front passenger compartment, which are normally directed towards the front dashboard/windshield in the case of a car, are directed to the reflector. In consequence of the reflector's shape, sound is thereby reflected and focused by the reflector to the second focus of the ellipsoid. Accordingly, a sound pressure of a voice signal reaches the axis of the at least one reflector and is reflected by the ellipsoid shaped surface towards the second foci, the shape defined so the second foci is in the back passenger compartment.

BRIEF DESCRIPTION OF THE DRAWINGS

FIG. 1 is a schematic representation of an ellipsoid;

FIGS. 2A and 2B are schematic representations of top plan and side views, respectively, of a preferred embodiment of the invention;

FIG. 3A is schematic representation of a top plan view of an automobile within which the present invention has been installed; and FIG. 3B is schematic representation of a side cutaway view of an automobile within which the present invention has been in stalled.

DETAILED DESCRIPTION OF THE PREFERRED EMBODIMENTS

In one embodiment, the acoustic lens device of this invention is constructed to facilitate conversation between front and back seated passengers in an automobile passenger compartment. The device is preferably located at or proximate the front windshield at a distance from the reflector equal to its first focus. Hence, sound waves emanating from the mouths of front facing and communicating passengers are essentially emanating from the focus of the reflector portion of the device. Accordingly, the reflector receives and reflects the sounds from the first foci and directs them to the second focus which is located in another portion of the automobile. Hence, individuals seated in the back seat at or near the second focus are able to hear voice communication clearly which would be normally difficult to hear because of the acoustically challenged nature of automobile passenger compartments.

FIG. 1 depicts an ellipsoid of revolution 10 to illustrate the basic principle of the present invention. If light or sound waves issue from one focus 12, they are reflected by the inner surface of the ellipsoid of revolution to the other focus 14. If a source for producing sounds or the like is placed at focus 14, sounds or the like produced thereat reach focus 12.

FIGS. 2A and 2B illustrate top plan and side views of a preferred embodiment of an acoustic lens device of this invention 100. Device 100 shown thereat includes a reflector 110 whose inner surface comprises an ellipsoidal and/or parabolic surface 120. Accordingly, the ellipsoid or parabolic surface 120 defines two foci, 130, 140, which are better exemplified in drawing FIGS. 3A and 3B, which highlight the preferred embodiment 100 within an automobile 150. The first focus 130 of the two foci is located within the front seat portion of the passenger compartment 160. The second focus 140 of the two foci is located in the back seat passenger portion of automobile 160 when the device 100 is placed on or near the dashboard proximate the windshield 170. The closer the sound source is to the first focus, the better the reflection and focusing of the sound to the second focus, and vice versa.

It follows that utilizing the device 100 of this invention allows users to easily communicate between front and back seat passenger portions regardless of the direction each communicator is facing when emitting oral sounds. It should be noted that the preferred embodiment has been included herein for exemplary purposes only, that the scope of the invention is to be limited only by the appended claims which follow. For that matter, the inventors of the present invention contemplate providing a device of the invention as part of the rear view mirror or directly within the molding of the windshield.

What is claimed is:

1. An acoustic lens device for use in facilitating oral communication within an acoustically challenged space within a motor vehicle which includes front and back passenger portions, a dashboard and a windshield, the lens device comprising:

at least one acoustic reflector for positioning proximate to the windshield of the front passenger portion of the motor vehicle, said reflector being formed as a portion of an ellipsoidal surface obtained when an ellipse having two foci on an axis extending in a substantially vertical direction is rotated about the axis such that said first focus of said ellipsoidal surface is located at or near an upper portion of a front seat of said motor vehicle, and a base mountable on the dashboard;

wherein said at least one acoustic reflector is disposed on said base such that a second focus is located in back passenger portion of said motor vehicle such that voice signals emitted from the mouths of persons seated in the passenger portion at said first focus are directed to said reflector and refocused to said second focus facilitating oral communication.

2. The acoustic lens device of claim 1, wherein said at least one acoustic reflector includes a base portion, the base portion having a rubber-like surface comprising a plurality of suction cups, and is attached to said dashboard by the plurality of suction cups mounted to said base portion.

3. A sound focusing apparatus for use in an automobile to redirect sound waves traveling in front and back passenger compartments of the automobile, where the front passenger compartment includes a dashboard and an automobile windshield, the apparatus comprising:

a transparent horn-like sound collector including an ellipsoidal reflector portion and a base portion, the collector portion mounted at the base portion to the dashboard proximate the windshield such that a first focus of the ellipsoidal reflector portion is positioned proximate the front passenger portion such that a second focus is located behind the front passenger portion;

wherein voice signals generated at the first and second focus and directed towards the windshield of the automobile arrive at the apparatus and are redirected to respective front and back passenger portions.

4. The sound focusing apparatus of claim 3, wherein said sound collector is incorporated within a rear-view mirror proximate the windshield.

5. The sound focusing apparatus of claim 3, wherein said sound collector comprises a flexible material.

6. The sound focusing apparatus of claim 3, wherein said sound collector is constructed as a portion of the windshield.

7. A sound focusing apparatus for use in an automobile to redirect sound waves traveling in front and back passenger compartments of the automobile, where the front passenger compartment includes a dashboard and windshield, the sound focusing apparatus comprising:

a transparent horn-like sound collector including an ellipsoidal reflector portion and a base portion, the reflector portion mounted at the base portion, and the base portion disposed at the windshield wherein a first focus of the reflector portion is positioned in front passenger portion near the reflector, and a second focus is located in the back passenger portion;

wherein voice signals generated at the first focus and directed towards the windshield of the automobile arrive at the reflector and are redirected to the back passenger portion at said second focus.

8. The sound focusing apparatus of claim 7, wherein said base is mounted fixedly on the windshield.

* * * * *